US005809856A

United States Patent [19]

Reist et al.

[11] Patent Number: 5,809,856

[45] Date of Patent: Sep. 22, 1998

[54] METHOD FOR CUTTING CONTINUOUSLY CONVEYED FLAT PRODUCTS MADE OF PAPER OR OF SIMILAR MATERIALS

[75] Inventors: Walter Reist; Rudolf Infanger, both of Hinwil, Switzerland

[73] Assignee: Ferag AG, Hinwil, Switzerland

[21] Appl. No.: 722,625

[22] Filed: Sep. 27, 1996

[30] Foreign Application Priority Data

Oct. 4, 1995 [CH] Switzerland ..... 02800/95

[51] Int. Cl.[6] ..... B26D 1/10

[52] U.S. Cl. ..... 83/34; 83/356.2; 83/636; 83/642; 83/647; 83/934

[58] Field of Search ..... 83/34, 37, 38, 83/49, 52, 934, 356.2, 355, 747, 751, 753, 769, 636, 697, 642, 646, 13

[56] References Cited

U.S. PATENT DOCUMENTS

| | | | |
|---|---|---|---|
| 1,966,078 | 7/1934 | Ohmer et al. | 83/636 X |
| 2,808,883 | 10/1957 | Knokey | 83/356.2 |
| 3,530,755 | 9/1970 | Gugler | 83/642 X |
| 3,690,208 | 9/1972 | Muller | 83/934 X |
| 3,732,764 | 5/1973 | Gerber | 83/34 |
| 4,038,893 | 8/1977 | Reist | 83/154 |
| 4,202,232 | 5/1980 | Muller | 83/642 X |
| 4,516,455 | 5/1985 | Peters | 83/934 X |
| 4,984,491 | 1/1991 | Bragaglia | 83/642 X |
| 5,113,731 | 5/1992 | Reist | 83/35 |
| 5,125,304 | 6/1992 | Petersen | 83/934 X |
| 5,501,127 | 3/1996 | Stauber | 83/100 |
| 5,503,051 | 4/1996 | Stauber | 83/349 X |

FOREIGN PATENT DOCUMENTS

| | | | |
|---|---|---|---|
| 124 198 | 11/1984 | European Pat. Off. . | |
| 367 715 A1 | 9/1989 | European Pat. Off. . | |
| 418 529 | 3/1991 | European Pat. Off. . | |
| 673 729 | 9/1995 | European Pat. Off. . | |
| 908472 | 4/1946 | France | 83/646 |
| 1076714 | 10/1954 | France . | |
| 1963861 | 9/1978 | Germany | 83/934 |
| 37 05 168 | 9/1988 | Germany . | |
| 281779 | 8/1990 | Germany | 83/934 |
| 685 153 | 4/1995 | Switzerland . | |

*Primary Examiner*—Eugenia Jones
*Assistant Examiner*—Charles Goodman
*Attorney, Agent, or Firm*—Walter C. Farley

[57] ABSTRACT

Products (2) made of paper or similar materials are cut along predetermined cutting lines in a drawing cut between crossed knife edges while being conveyed continuously in a dense conveying stream in which their main surfaces are orientated substantially perpendicular to the conveying direction (v). For this purpose a counter knife (1) with a guide edge (11) is allocated to each product (2) and the products (2) together with the counter knives (1) are conveyed past at least one cutting knife (5) with a cutting edge (51) having two ends, whereby the cutting edge (51) of the cutting knife (5) substantially lies in the plain formed by the guide edges (11) of the counter knives (1) and forms a cutting angle (α) with the guide edges (11). While the cutting edge (51) forms a cutting formation with one guide edge (11) in which cutting operation the two edges are intersecting in a cutting area (4) being shifted along the cutting line, the cutting knife (5) is additionally drawn in a direction (Z) parallel to the guide edge (11) or along the cutting edge (Z') or in a direction lying in between said two direction and opposed to the direction in which the cutting area (4) is shifted. Between successive cutting operation with successive counter knives (1), the cutting knife (5) is reset (R, R') in an direction opposed to the direction of the drawing movement (Z, Z').

9 Claims, 4 Drawing Sheets

FIG. 6a
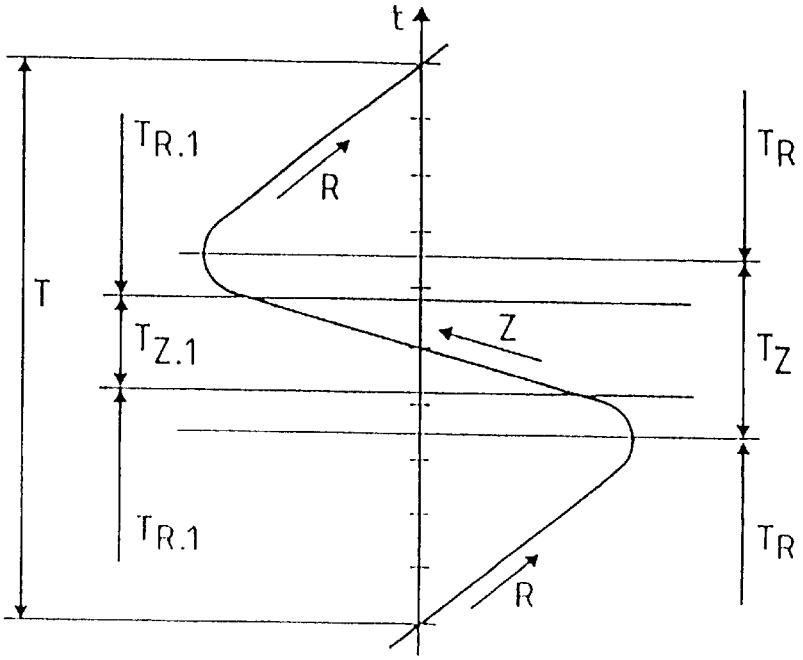
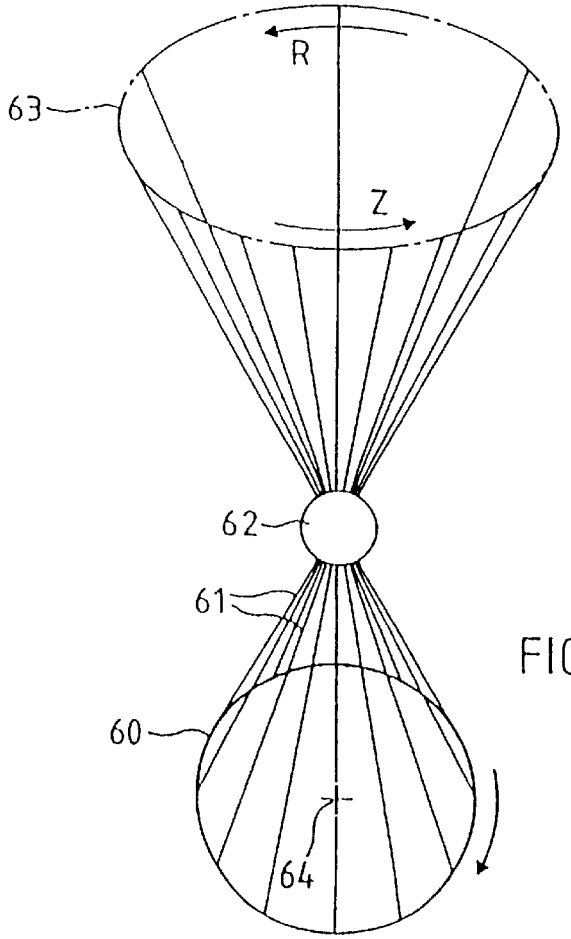
FIG. 6b

METHOD FOR CUTTING CONTINUOUSLY CONVEYED FLAT PRODUCTS MADE OF PAPER OR OF SIMILAR MATERIALS

FIELD OF THE INVENTION

The invention lies in the field of cutting techniques and concerns a method for cutting continuously conveyed flat products made of paper or of similar materials.

BACKGROUND OF THE INVENTION

Products made of paper such as e.g. printed products in form of magazines, brochures, signatures etc. are often cut along at least one edge. Such cutting process is most economical if the products are cut while being conveyed continuously in a dense stream and if the devices for cutting are designed and arranged such that the products must not be reordered or must only be slightly reordered for cutting.

When cutting continuously conveyed products, very good cutting qualities are e.g. achieved with a cutting operation between the endless cutting edge of a rotating knife and the guide edge of a counter knife which guide edge limits a guide surface substantially parallel to the rotation axis of the cutting knife. Every product to be cut is brought onto the guide surface such that the cutting line (predetermined line along which the product is to be cut) comes to lie on the guide edge. Then the product is guided towards the rotating knife with the guide surface parallel to this cutting line and is then cut along the cutting line by the interaction of cutting edge and guide edge. In the area of the cutting operation the cutting edge of the rotating knife moves towards the product to be cut and the underlying guide edge of the counter knife with a speed which is greater than the speed of the product such that the cutting effect is that of a drawing cut between crossed knife edges.

Products to be cut as described above must be conveyed such that the cutting line is parallel to the conveying direction. This means they are e.g. conveyed in a stream of individual products or of products in scaled formation, whereby individually conveyed products form a stream of very little density and whereby in a scaled formation the exact positioning of the cutting lines relative to the guide edge is difficult and the varying thickness of the stream can lead to cutting difficulties. Furthermore, with the described cutting method only two opposite edges of rectangular products can be cut. In order to cut the other two edges, the products must be reordered.

Furthermore, cutting methods are known which are carried out on product streams in which the main surfaces of the products are not parallel but substantially perpendicular to the conveying direction such that all thinkable cutting lines lie in planes which are not parallel to the conveying direction and such that the cutting method described above cannot be used. In this context, the expression "main surfaces" is used in its conventional meaning, referring to the generally parallel, front and back surfaces of a magazine, newspaper or other flat article between which there is a thickness usually much smaller than the dimensions of the front and back surfaces. A method and a device for cutting such conveyed products along three cutting lines at right angles to each other, are e.g. described in publication EP-0367715 which corresponds to U.S. Pat. No. 5,113,731. According to this description a counter knife is allocated to each product to be cut, the product is positioned against the counter knife such that a cutting line lies on the at least one guide edge of the counter knife and then product and counter knife are guided together past a cutting knife such that the cutting edge of the cutting knife and the guide edge of the counter knife are brought into a cutting formation in which the product is cut along the cutting line. The described cutting knives are rotating disc knives with endless cutting edges and a rotation axis perpendicular to the plane formed by the cutting lines of consecutive products to be cut or they are rotating cutting rollers with at least one cutting edge arranged helically thereupon, whereby the rotation axes of the cutting roller is substantially parallel to the plane of the cutting lines. Cutting rollers (but not disc knives) can also be used if the plane formed by the cutting lines is not even but has e.g. the form of a cylinder jacket.

According to the method described in U.S. Pat. No. 5,113,731, the products can be cut in a drawing cut between crossed knife edges. However, the cutting parameters are at least partly determined within a narrow range by the cutting arrangement and/or are irrevocably coupled to each other, i.e. they cannot be adjusted individually. Thus e.g. with a possible arrangement using a disc knife neither the speed of cutting nor the angle of cutting (angle between the two edges in the cutting formation) can be kept constant during the cutting operation. When a cutting roller is used the speed of cutting and the angle of cutting can be kept constant during cutting but they are exactly determined by the helical pitch of the cutting edges and by the conveying speed.

SUMMARY OF THE INVENTION

An object of the invention is to provide a method with which flat products made of paper or of a similar material conveyed continuously in a dense stream can be cut in a drawing cut between crossed knife edges along cutting lines which are not parallel to the conveying direction, whereby a constant very high cutting quality along the whole length of the cuts is achieved. This high cutting quality is achievable for products with features variable to a very high degree.

The method according to the invention is based on allocating a counter knife with a guide surface and at least one guide edge limiting the guide surface, to each of the continuously conveyed products (or product groups with super-positioned cutting lines) such that one of the main surfaces of each product lies against the guide surface of the counter knife and a predetermined cutting line on each product lies against the at least one guide edge. The products are then guided, together with the counter knives, past a cutting knife with a cutting edge which cutting edge has two end points (is not endless) and is positioned substantially in the plane formed by the moving guide edges of the counter knives and at an angle (cutting angle) to the counter knives. Thereby each counter knife with a product lying against its guide surface facing the cutting knife is brought into cutting formation with the cutting knife in an area in which the guide edge and the cutting edge intersect. During cutting this cutting area moves along the guide edge or along the cutting line respectively from its one end point to the other, whereby the product is cut between the crossed knife edges. In order to achieve a drawing cut between crossed knife edges (cutting edge and guide edge), the cutting knife is simultaneously drawn against the shifting direction of the cutting area, in a drawing movement which is directed either parallel to the guide edge of the counter knife or along the cutting edge of the cutting knife or between the two directions defined by guide edge and cutting edge.

Between the cutting operation of the cutting knife with one counter knife and the cutting operation of the cutting knife with the next counter knife the cutting knife is moved back to its starting position. The cutting knife is thus moved in an alternating movement in opposed directions, whereby the movement against the direction of the shifting of the cutting area is used during cutting as drawing movement and the movement in the direction of the shifting of the cutting area is for resetting the knife between two cutting operations.

BRIEF DESCRIPTION OF THE DRAWINGS

The method according to the invention is described in connection with the following figures, wherein

FIGS. 6*a* and 6*b* are developments of the geometry of a gear for generating the cutting knife movement according to FIG. 5.

DESCRIPTION OF PREFERRED EMBODIMENTS

Figure 1:
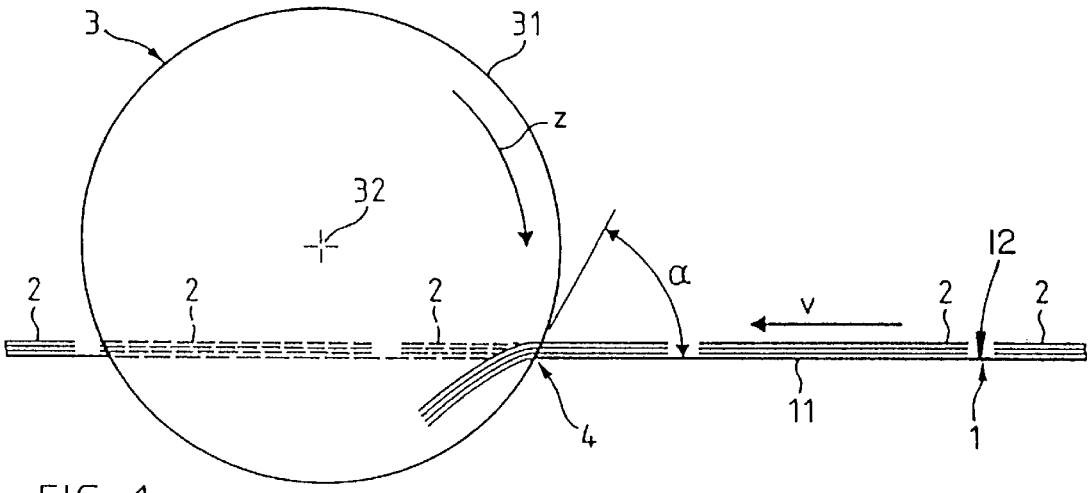
FIG. 1 PRIOR ART
FIG. 1 is a schematic side elevation of a prior art cutting arrangement making a drawing cut between crossed knife edges when carried out on products conveyed parallel to a cutting line.

FIG. 1 diagrammatically shows an arrangement for carrying out a drawing cut between crossed knife edges on products conveyed parallel to predetermined cutting lines. This is a well-known method for carrying out a drawing cut between crossed knife edges. A counter knife 1 has a guide surface 12 (e.g. orientated perpendicular to the plane of the drawing) which is laterally limited by a guide edge 11 (lying in the plane of the drawing). Products 2 lie against the guide surface such that a predetermined cutting line is positioned on the guide edge 11. The products together with the guide surface are conveyed towards a disc-shaped cutting knife 3. Knife 3 has a circular, endless cutting edge 31 and is rotated around a rotation axis 32 e.g. parallel to the guide surface such that cutting edge 31 crosses guide edge 11 in a cutting area 4. The direction of rotation of knife 3 is such that in the cutting area, cutting edge 31 runs towards the guide surface 12 of counter knife 1. If the circumferential speed of the cutting knife is substantially equal to the conveying speed v, the cut achieved is a cut between crossed knife edges. Usually though, the circumferential speed of the knife (z) is considerably higher than the conveying speed v such that a drawing cut between crossed knife edges results, i.e cutting edge 31 is drawn through cutting area 4 and towards the product to be cut with a speed z. In essence, the absolute value of conveying speed v is equal to the absolute value of cutting speed, and the symbol v can be used for either.

FIG. 1 also shows the cutting angle $\alpha$, i.e. the angle between guide edge and cutting edge (11, 31) when in cutting formation in cutting area 4 into which the products to be cut are conveyed.

It can also easily be seen from FIG. 1 that speeds v (cutting speed) and z (drawing speed) are independently adjustable and remain constant during cutting. Cutting angle $\alpha$ is also constant during cutting and easily adjustable (adjustment of the distance between counter knife 1 and rotation axis 32 of cutting knife 3). The disadvantages of the cutting method illustrated in FIG. 1 have been mentioned earlier.

Figure 2:
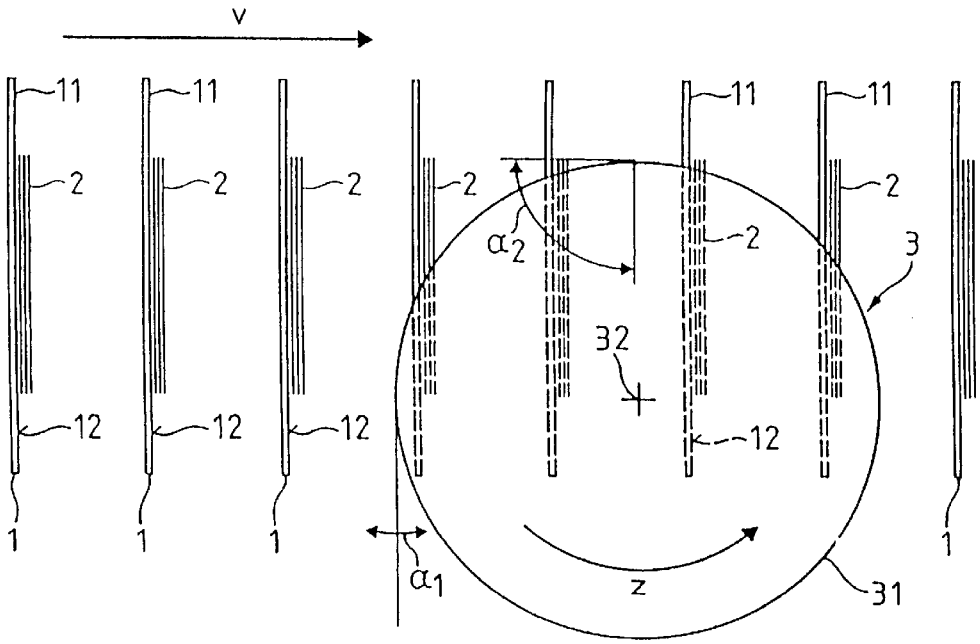
FIG. 2 PRIOR ART
FIG. 2 is a schematic side elevation of a prior art cutting arrangement making a drawing cut between crossed knife edges when carried out on products with cutting lines arranged transversely to the conveying direction.

FIG. 2 shows a further known method for carrying out drawing cuts between crossed knife edges on continuously conveyed products, wherein the products are conveyed in a dense stream in a direction substantially transversely (generalized: not in parallel) to their main surfaces.

Counter knives 1 with guide edges 11 (in the paper plane) and guide surfaces 12 (e.g. perpendicular to the paper plane) are allocated to the products such that a product 2 (or a group of products) lies against a guide surface 12 of each counter knife 1 and a predetermined cutting line is positioned against guide edge 11. Products 2 and counter knives 1 are moved together and with a conveying speed v towards a rotating disc-shaped cutting knife 3. This cutting knife 3 has a round, i.e. endless cutting edge 31 and a rotation axis 32 which is arranged in parallel to the main surfaces of products 2.

From FIG. 2 it can be seen that the cutting operation on the bottom end (in the figure) of products 2 begins with a cutting angle $\alpha_1$ of ca. 0° (cutting edge more or less parallel to guide edge 11) and ends on the top end of the product at a cutting angle $\alpha_2$ of ca. 90°. It can also be seen from FIG. 2 that the cutting speed is high at the beginning of the cut and low at the end of the cut and that the cutting speed is not dependant on the rotation speed of the knife but only on the conveying speed v. The circumferential speed of the cutting knife is the drawing speed z which is more or less constant during the whole cutting operation. Obviously, the parameters of the cutting cannot be kept constant for one cutting operation except in case that, compared with the width of the product to be cut, the cutting knife is very large such that the cut is carried out within a very small sector of the cutting knife which however is not advantageous regarding the necessary device.

Figure 3:
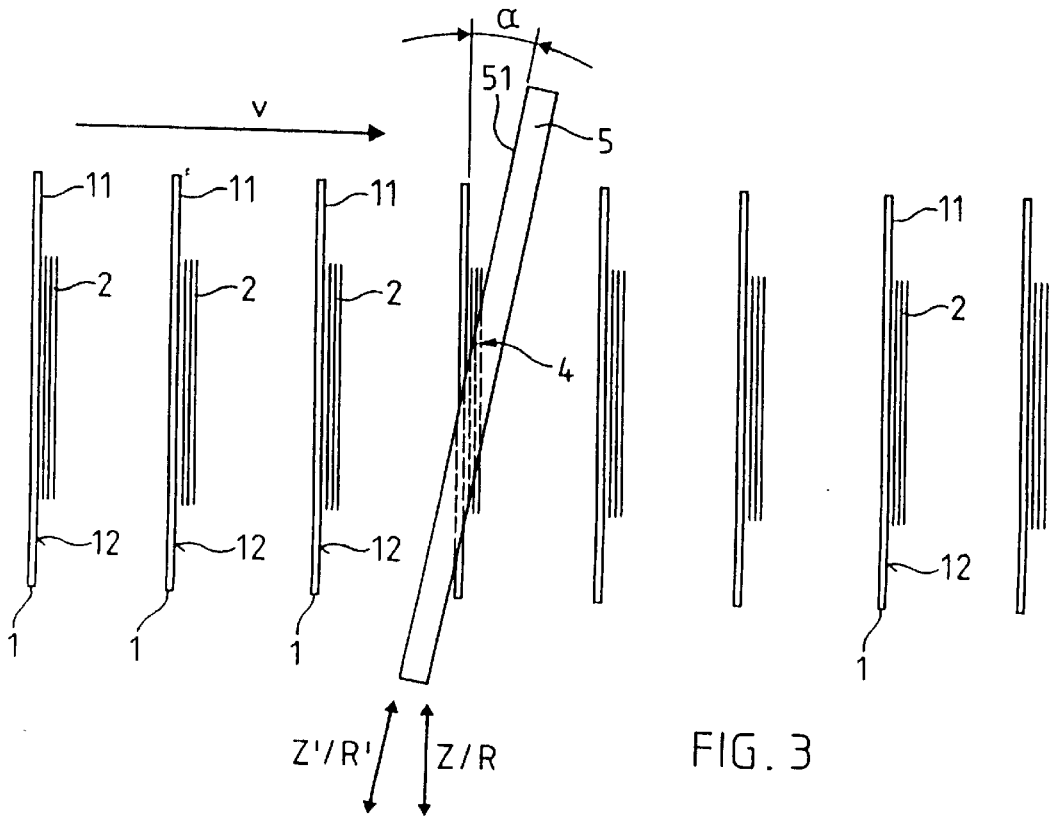
FIG. 3 is a schematic side elevation of the method according to the invention for carrying out a drawing cut between crossed knife edges on products with cutting lines arranged transversely to the conveying direction.

FIG. 3, in contrast to FIGS. 1 and 2, shows the method according to the invention for cutting products which are conveyed in a dense stream in a direction substantially perpendicular to their main surfaces, in a drawing cut between crossed knife edges.

Again, counter knives are allocated to products 2 such that one product or one group of products lies against each guide surface 12 (e.g. perpendicular to the plane of the drawing) of a counter knife 1 and the predetermined cutting line is positioned on guide edge 11 (in the drawing plane). Products 2 and counter knives 1 are guided together towards and past a cutting knife 5 with cutting edge 51, wherein the cutting edge 51 has two ends and is positioned substantially in the plane formed by the plurality of moving guide edges or cutting lines respectively and is arranged such that it crosses the conveyed counter knives 1 in a cutting area 4 at a cutting angle a and that cutting area 4 is shifted from one end of the product 2 to the other when the product is conveyed past the cutting knife. While cutting edge 51 of knife 5 is involved in a cutting operation together with guide edge 11, knife 5 is additionally drawn in a drawing movement Z parallel to guide edge 11 and in opposite direction to the shifting of cutting area 4. The drawing movement (Z') can also be carried out along the line of cutting edge 51 or with a direction between Z and Z'.

Between two cutting operations, knife 5 is repositioned to the starting point with a resetting movement R or R'.

The cutting process according to FIG. 3 is a drawing cut between crossed knife edges with the following features:

Cutting angle α and cutting speed (shifting speed of the cutting area) are constant during cutting.

Cutting angle α is easily adjustable, the cutting speed is determined by cutting angle α and conveying speed v, or by the relative position and movement of counter knife 1 and knife 5 respectively.

The drawing speed is independent of cutting angle α and conveying speed v and is adjustable by means of a correspondingly controllable drive.

The adjustability of the cutting angle α is restricted by the condition that only one counter knife 1 can be involved in the cutting operation with cutting knife 5 at a time and that between subsequent cutting operations, sufficient time must be left for resetting the cutting knife (movement R). In other words this means that the largest value of cutting angle α is limited by parameters of the device such as conveying speed, distance between the products, required power for the resetting movement etc. The minimum value of the cutting angle is not limited, i.e. it can be 0° (guide edge and cutting edge are parallel), in which case the cut is then still a drawing cut but not a drawing cut between crossed knife edges. The drawing speed is variable within a wide range when cutting edge 51 of knife 5 is considerably longer than the cutting line along which the cut is to be carried out and when it is coupled with a correspondingly powerful drive.

As mentioned earlier, counter knives 1 are normally guided past cutting knife 5 in a continuous manner. This however is not a condition. Cutting knife 5 could just as well be moved and counter knives 1 could be stationary or both knives (1 and 5) could be moved against each other during the cutting operation. It can also be imagined that counter knife 1 and products 2 in FIG. 3 are conveyed from right to left and are overtaken by knife 5 which is moved in the same direction but with greater speed. However, relative movement between counter knife 1 and knife 5 is a condition of the method: counter knife 1 must move, with its guide surface in front, towards cutting edge 51.

In FIG. 3, counter knives 1 are shown perpendicular to the conveying direction of v. This again is not a condition of the method according to the invention. It is however a condition that the cutting lines or guide edges 11 of counter knives 1 respectively are not arranged to be parallel to the conveying direction of v.

In FIG. 3, counter knives 1 are arranged parallel to each other and the conveying direction of v runs in a straight line (in the drawing plane). Such an arrangement is e.g. a straight conveying line on which the products are conveyed in compartments, which are separated from each other by separating walls. The conveying compartments are e.g. open towards the top and counter knives are attached to the separating walls or the separating walls themselves are designed as counter knives. The plane formed by the moving guide edges or the moving cutting lines respectively is even in this particular arrangement (paper plane). This is a special case and again no condition of the method according to the invention.

Figure 4:
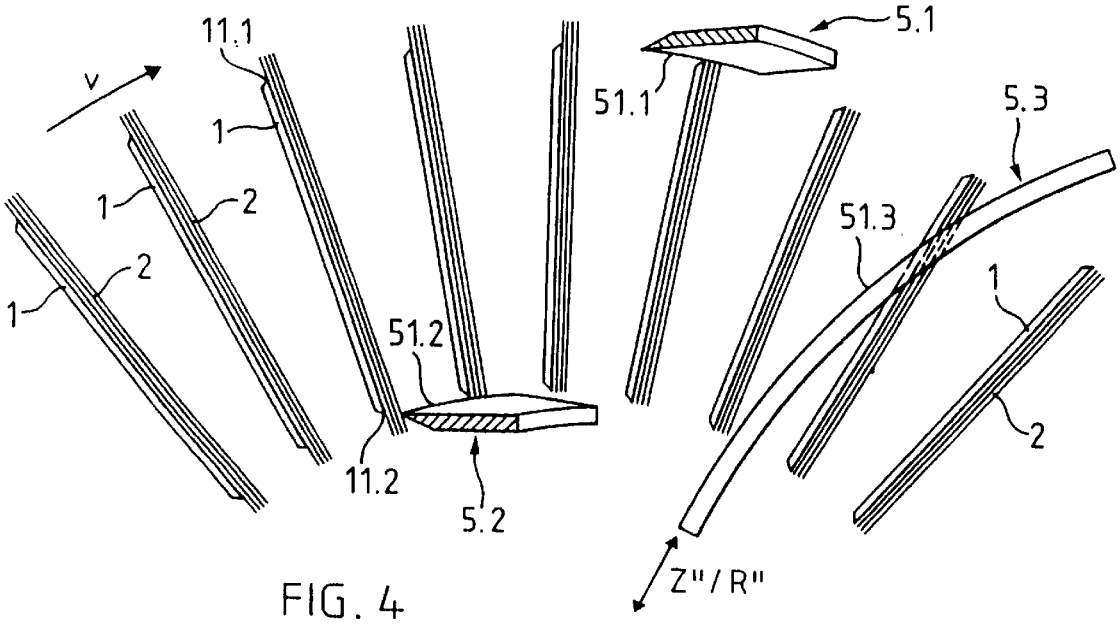
FIG. 4 is a schematic side elevation of further embodiments for carrying out the method according to the invention.

FIG. 4 shows a cutting drum as an further embodiment distinct from the special case shown in FIG. 3. The counter knives 1 (e.g. separating walls of conveying compartments attached axially to the drum) and products 2 are conveyed in such a drum along a circular arc (in the drawing plane) and can be cut e.g. along four cutting lines at right angles to each other. The two lateral cutting lines (moving parallel to the paper plane) of consecutive products are not in parallel but positioned radially to the circular arc of the conveying direction, while an inner and an outer cutting line (perpendicular to the drawing plane) of consecutive products are moved in parallel, however on a curved surface (cylinder jacket). Knives 5.1 and 5.2 for cutting along the inner and the outer cutting lines of the products and a knife 5.3 for cutting along the one lateral cutting line of the products are shown. As it is advantageous to cut along both lateral cutting lines simultaneously a further knife, similar to knife 5.3 is provided. This knife cannot be seen in the figure because it is hidden from sight by knife 5.3.

The two knives 5.1 and 5.2 with cutting edges 51.1 and 51.2 correspond to knife 5 in FIG. 3 in a projection onto the plane formed by guide edges 11.1 and 11.2, i.e. in this projection their cutting edges 51.1 or 51.2 respectively are straight. In order to be able to follow the arcuate movement of guide edges 11.1 and 11.2 however, cutting edges 51.1 and 51.2 must be adapted helically to the conveying arc. As for this reason a drawing movement (Z' in FIG. 3) along cutting edge 51.1 or 51.2 must run helically it is advantageous for knives arranged thus to carry out the drawing movement (Z in FIG. 3) parallel to guide edges 11, i.e., in the axial direction of the drum (or perpendicular to the drawing plane).

Knife 5.3 also comprises a curved cutting edge 51.3 (not shown in scale) for cutting products conveyed with wedge shaped spaces between them (not in parallel) such that cutting with a constant cutting angle is possible. Such a curve can also be approximated by a circular curve and the drawing or resetting movement (Z"/R") can be carried out on this curve. For products for which a constant and high quality cut can be achieved without an exactly constant cutting angle, knife 5.3 can also be designed to have a straight cutting edge.

According to the form and position of the cutting lines and according to the path of conveyance of the products to be cut, the knives are to be equipped with correspondingly designed cutting edges and corresponding guiding means and drive means for generating the necessary drawing movement and resetting movement. Drawing movements along the cutting edge of the knife are theoretically only possible for cutting edges which run on a straight line, on an even circle or on a helical line with a circular projection. For differently shaped cutting edges, it might be possible to approximate such movements although only within a narrow tolerance for the cutting area.

As previously mentioned in connection with FIG. 3 the cutting edges 5.1, 5.2 and 5.3 need not necessarily be arranged to be stationary. At a given conveying speed (rotation of the counter knives and products around the drum axis) and a given cutting angle, it is possible to vary the cutting speed by rotating the cutting knives also either slower or faster than the counter knives but with the same rotation direction around the drum axis. Depending on the direction in which the cutting edge approaches the guide edge, the products must be against the one or the other side of the guide edges. For an embodiment of this kind a plurality of similar cutting knives is to be provided on a rotor.

Figure 5:
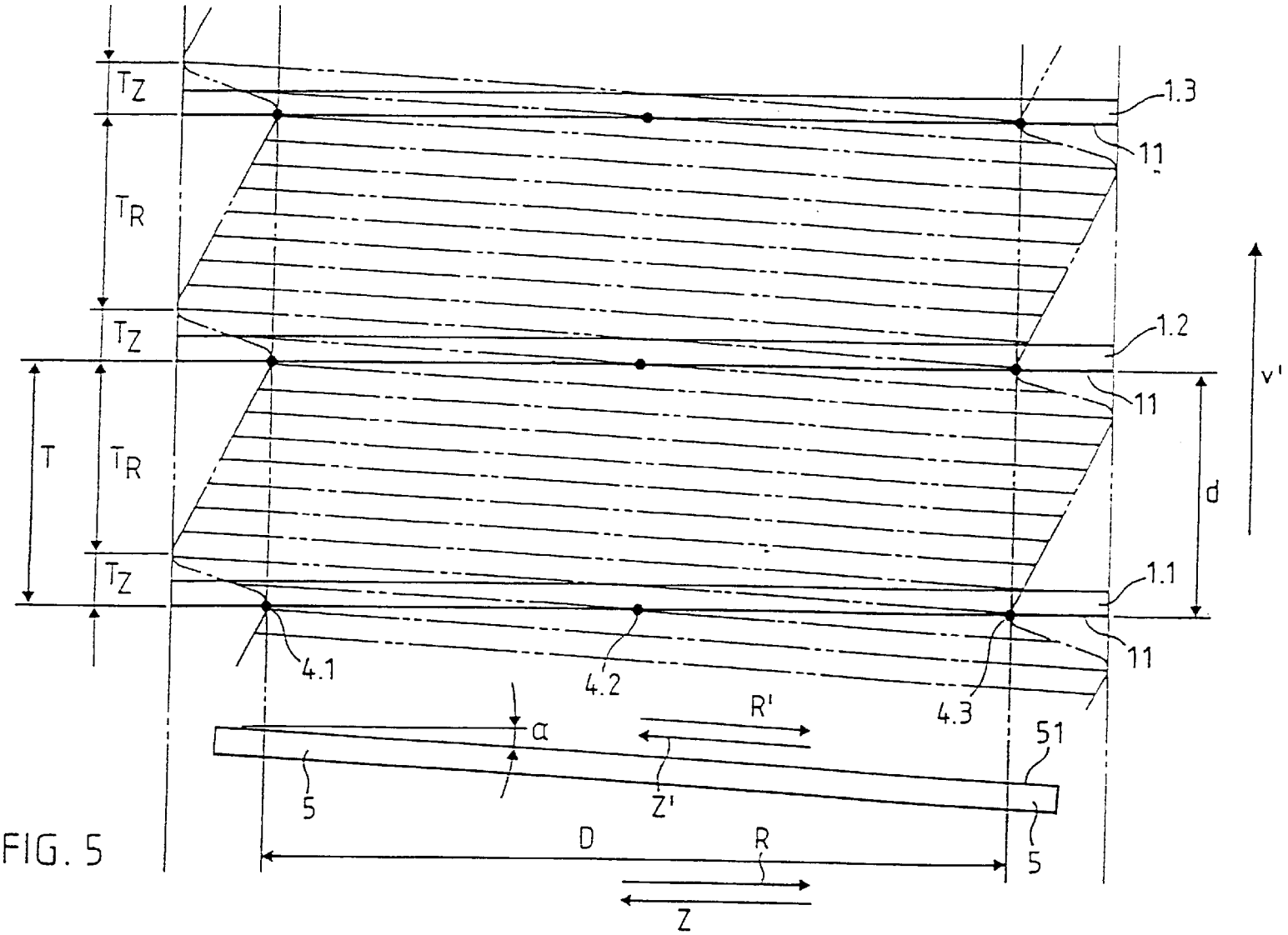
FIG. 5 is a diagram showing the course of movements of the cutting knife according to FIG. 3 in detail.

FIGS. 5, 6*a* and 6*b* show in detail a device for carrying out the inventive cutting method (FIG. 5) and a drive (FIGS. 6*a* and 6*b*) for generating the drawing/resetting movement of the cutting knife of this device.

FIG. 5 corresponds substantially to FIG. 3 and shows in detail the drawing/resetting movement (Z'/R') of cutting knife 5. For reasons of simplification knife 5 is shown as if moving with a speed v' and with its cutting edge 51 facing downstream past a plurality of counter knives 1.1 to 1.3 with guide edges orientated against the movement of knife 5. The relative movement between cutting edge 51 and guide edges 11 thus generated is exactly the same movement as that of a stationary cutting knife 5 and counter knives 1.1, 1.2, 1.3 conveyed past it, which of course is the preferred embodiment.

Parallel to the cutting edge 51 of knife 5 from bottom to top of the Figure, consecutive positions of cutting edge 51 are shown with broken lines. At intersections of these lines with guide edges 11 of the counter knives consecutive positions of the cutting area shifting from left to right are designated with 4.1, 4.2 and 4.3. The necessary, alternating drawing/resetting movements of knife 5 are seen from the shift of the ends of the broken lines. This shifting is directed from right to left (drawing movement Z'), i.e. opposed to the direction of shifting cutting area, when cutting edge 51 is engaged in a cutting operation with one of the guide edges 11 and in the opposite direction (resetting movement R') between the end of one cutting operation with one counter knife and the beginning of a following cutting operation with the following counter knife.

As described in connection with FIG. 3, alternating drawing/resetting movements parallel to guide edges 11 are possible also which is shown with corresponding arrows Z/R. At a small cutting angle a the difference between the two variants Z'/R' and Z/R is minimal.

The time T available for one movement cycle of cutting knives 5 is determined by distance d between the guide edges 11 of the counter knives and by the conveying speed v and is d/v. The part $T_z$ of this cycle time required for drawing movement Z is dependent on the distance between the guide edges, on the cutting angle a and on the length D of the cut to be executed (maximum length of a cutting line) and is approximately D (tan $\alpha$) d. Resetting movement R must be carried out in the remaining cycle time $T_R$. The amplitude of the alternating movement is mainly determined by the desired drawing speed.

In the preferred applications cutting angle a is small (in the range of 2° to 10°) and the distance between the counter knives is such that a larger part of the cycle time is available for the resetting movement.

The alternating movement of the cutting knife (drawing/resetting movement) is advantageously a sinusoidal movement in which the mounting and falling parts of the curve may have differing slopes.

For the embodiment shown in FIG. 5 the whole movement in the drawing direction is used for the drawing cut with crossed knife edges. This means that the speed of drawing increases at the beginning of the cutting operation and decreases towards the end of it. It is also possible to use only a middle part of this movement, whereby the drawing speed becomes more constant during the cutting operation. The amplitude of the alternating knife movement and the speed of the resetting movement must be increased correspondingly.

FIG. 6*a* and 6*b* show diagrammatically an example of a gear for generating an alternating drawing/resetting movement for a method according to FIG. 5, wherein the movement to be generated consists of alternating faster drawing movements and slower resetting movements. The gear is a slider crank mechanism.

As shown schematically in FIG. 6*b*, the gear comprises a crank drive 60 and a connecting rod 61 driven by the crank drive and guided by a sleeve pivoting around axis 62. The connecting rod is shown in different positions by means of corresponding lines. When the crank drive is rotating in the direction of the arrow the free end of the connecting rod (or any point on the connecting rod beyond the axis 62) moves on an elliptical line 63 in direction of the arrow. On a time axis T this movement which is illustrated in FIG. 6*a* proves to be the desired, sinusoidal movement with different speeds for the mounting and falling parts of the curve.

This kind of gear allows adjustment of the cycle time by adjusting the drive speed. The form of curve, i.e. the difference of speeds on mounting and falling parts of the curve is adjustable by adjustment of the distance between axis 62 of the pivoting sleeve guide and rotation axis 64 of the crank drive 60. The amplitude of the movement is adjustable by adjustment of the length of connecting rod 61 or by corresponding positioning of the point on connecting rod 61 to which the cutting knife is connected directly or indirectly.

FIG. 6*a* shows the course of movement of a point on the crank on a time axis t. This movement is, as in FIG. 5, divided into drawing movement Z and resetting movement R (corresponding parts of the cycle time: $T_z$ and $T_R$). Cycle time T is also divided into a part $T_{Z.1}$ with a substantially constant drawing speed and a corresponding resetting part $T_{R.1}$, whereby the resetting part $T_{R.1}$, additionally to the movement in the opposed direction, also comprises the accelerated and decelerated parts of the movements in drawing direction.

The gear shown diagrammatically in FIG. 6*b* can be designed and produced by one skilled in the art without problems. This is also the case for suitable connection means between the gear and the cutting knife. It should also be no problem for the one skilled in the art to adapt gear and connection means correspondingly for other variants of the method according to the invention.

We claim:

1. A method for cutting flat products along a predetermined cutting line, the flat products each having two substantially parallel main surfaces, comprising the steps of supplying a plurality of flat products in a substantially continuous conveyed stream in a conveying direction with the main surfaces of the products substantially perpendicular to the conveying direction, providing a plurality of counter knives each having a guide edge, positioning one of said plurality of counter knives against one main surface of each product of the product stream with the predetermined cutting line of the product aligned with the guide edge of said one counter knife and conveying the counter knives with the products, providing a cutting knife with a cutting edge positioned to lie adjacent to a surface containing the guide edges of the counter knives being conveyed so that the cutting edge forms an acute angle with the guide edges, and producing relative movement between the cutting knife and each counter knife associated with each product in the product stream such that the cutting edge of the cutting knife and the guide edge of each counter knife interact in a cutting operation in which said edges substantially intersect at a cutting area and during which the cutting area is displaced along the predetermined cutting line, said movement including drawing the cutting knife during each cutting operation along a path from an initial position in a drawing direction substantially opposite to the direction of displacement of the cutting area, the drawing direction being one of (a) parallel to the cutting edge, (b) parallel to the guide edge, or (c) along a line lying between being parallel to one of those edges, said movement returning the cutting knife to the initial position between cutting operations.

2. A method according to claim 1 wherein the movement of the cutting knife draws and returns the cutting knife along the same path.

3. A method according to claim 1 wherein the movement of the cutting knife draws the cutting knife at one speed and returns the knife at a different speed.

4. A method according to claim 1 wherein said movement of drawing and returning of the cutting knife as a function of time is substantially sinusoidal.

5. A method according to claim 4 wherein the sinusoidal motion of the cutting knife is coordinated with movement of each counter knife such that the cutting knife is drawn with a substantially constant speed during each cutting operation.

6. A method according to claim 1 and including moving the guide edges of consecutive counter knives in the product stream parallel with each other and lie in the same plane, wherein the cutting edge of the cutting knife is straight, and including moving the cutting knife along straight lines during drawing and returning.

7. A method according to claim 1 and including moving the guide edges of consecutive counter knives in the product stream parallel with each other and lying axially in a cylindrical surface, wherein the cutting edge of the cutting knife lies along a helical line in the cylindrical surface and including moving the cutting knife along straight lines parallel with the cylinder axis during drawing and returning.

8. A method according to claim 1 and including moving the consecutive counter knives in the product stream so that the guide edges thereof lie along lines forming acute angles with each other and lie in the same plane, wherein the cutting edge of the cutting knife is straight or curved, and including moving the cutting knife along straight or curved lines during drawing and returning.

9. A method according to claim 1 wherein each counter knife comprises a plurality of guide edges, wherein a plurality of cutting knives are provided, and including cutting each product along different predetermined cutting lines in cutting operations.

* * * * *